US012287137B2

(12) United States Patent
Enoki et al.

(10) Patent No.: US 12,287,137 B2
(45) Date of Patent: Apr. 29, 2025

(54) SNOW MAKING APPARATUS

(71) Applicant: ESPEC CORP., Osaka (JP)

(72) Inventors: Hiroyuki Enoki, Osaka (JP); Kouki Sakane, Osaka (JP); Koshi Tamura, Osaka (JP)

(73) Assignee: ESPEC CORP., Osaka (JP)

( * ) Notice: Subject to any disclaimer, the term of this patent is extended or adjusted under 35 U.S.C. 154(b) by 577 days.

(21) Appl. No.: 17/572,000

(22) Filed: Jan. 10, 2022

(65) Prior Publication Data

US 2022/0228787 A1 Jul. 21, 2022

(30) Foreign Application Priority Data

Jan. 15, 2021 (JP) ..... 2021-004842

(51) Int. Cl.
*F25C 3/04* (2006.01)

(52) U.S. Cl.
CPC ..... *F25C 3/04* (2013.01); *F25C 2303/044* (2013.01); *F25C 2303/0481* (2013.01)

(58) Field of Classification Search
CPC ..... F25C 3/04; F25C 2303/044; F25C 2303/0481; F25C 2303/048; G01N 17/002
See application file for complete search history.

(56) References Cited

U.S. PATENT DOCUMENTS 5,062,279 A 11/1991 Kawashima et al.

FOREIGN PATENT DOCUMENTS

| | | | | | |
|---|---|---|---|---|---|
| GB | 2241316 | A | | 8/1991 | |
| GB | 2248678 | A | * | 4/1992 | ..... F25C 3/04 |
| JP | S58-075678 | A | | 5/1983 | |
| JP | S60-054069 | U | | 4/1985 | |
| JP | H03-045875 | A | | 2/1991 | |
| JP | H 03-152368 | A | * | 6/1991 | ..... F25C 3/04 |
| JP | H09-210526 | A | | 8/1997 | |
| JP | H09-329380 | A | | 12/1997 | |
| JP | H11-237152 | A | | 8/1999 | |
| JP | 2016-006362 | A | | 1/2016 | |
| JP | 2019-086162 | A | | 6/2019 | |
| WO | 00/34722 | A1 | | 6/2000 | |
| WO | 2020/250003 | A1 | | 12/2020 | |

OTHER PUBLICATIONS

An Office Action mailed by the Japanese Patent Office on Dec. 5, 2023, which corresponds to Japanese Patent Application No. 2021-004842 and is related to U.S. Appl. No. 17/572,000.

(Continued)

*Primary Examiner* — Paul M. West
(74) *Attorney, Agent, or Firm* — Studebaker Brackett PLLC

(57) ABSTRACT

A snow making apparatus includes: a snow making container having an inner space for snow making; a supply unit configured to supply fine snow or fine water droplets to the inner space; a catching unit configured to catch the fine snow or the fine snow formed of the water droplets; and a drive unit configured to move the catching unit toward a place where the fine snow is flying in the inner space. The catching unit is configured to be shaken thereby making snow caught by the catching unit fall off from the catching unit.

18 Claims, 6 Drawing Sheets

(56) References Cited

OTHER PUBLICATIONS

The extended European search report issued by the European Patent Office on Oct. 17, 2022, which corresponds to European Patent Application No. 22150772.6-1016 and is related to U.S. Appl. No. 17/572,000.

An Office Action; "Notice of Reasons for Refusal," mailed by the Japanese Patent Office on Feb. 4, 2025, which corresponds to Japanese Patent Application No. 2024-105344 and is related to U.S. Appl. No. 17/572,000; with English language translation.

* cited by examiner

SNOW MAKING APPARATUS

FIELD OF THE INVENTION

The present invention relates to a snow making apparatus.

BACKGROUND ART

Conventionally, as described in Japanese Patent Application Laid-Open No. H11-237152, there has been known a snow making apparatus that makes artificial snow fall in a room.

Japanese Patent Application Laid-Open No. H11-237152 includes: a snow catching body formed of an air-permeable film; a mist generator that generates mist in a room; a cooler and a blower that send low-temperature air into the room; and a striking body that strikes the snow catching body from a back side opposite to an adhering surface to which snow adheres. According to this snow making apparatus, the mist (atomized water droplets) generated by the mist generator is frozen in the low-temperature air, and this frozen body adheres to the adhering surface of the snow catching body. Then, by striking the snow catching body with the striking body from the back side, snow is shaken off from the snow catching body in the room.

In the snow making apparatus disclosed in Japanese Patent Application Laid-Open No. H11-237152, a water jetting port in the mist generator faces downward, and the adhering surface of the snow catching body extends along the vertical direction. With such a configuration, it is difficult to make the frozen body efficiently adhere to the adhering surface of the snow catching body. Accordingly, it is difficult to efficiently make the frozen body grow to agglomerated-snowflakes (snow having a large size formed by bonding of fine snowflakes having a fine particle size to each other) on the adhering surface.

SUMMARY OF THE INVENTION

It is an object of the present invention to provide a snow making apparatus capable of efficiently making agglomerated-snowflakes (large snowflakes).

A snow making apparatus according to an aspect of the present invention includes: a snow making container having an inner space for snow making; a supply unit configured to supply fine snow or fine water droplets to the inner space; a catching unit for catching the fine snow or fine snow formed from the water droplets; and a drive unit configured to move the catching unit toward a place where the fine snow is flying in the inner space. The catching unit is configured to be shaken thereby making snow caught by the catching unit fall off from the catching unit.

A snow making apparatus according to another aspect of the present invention includes: a snow making container having an inner space for snow making; a supply unit configured to supply fine snow or fine water droplets to the inner space; a catching unit for catching the fine snow or fine snow formed from the water droplets; a drive unit configured to move the catching unit toward a place where the fine snow is flying in the inner space; and a fall-off unit configured to make snow caught by the catching unit fall off from the catching unit.

DESCRIPTION OF EMBODIMENTS

Hereinafter, exemplary embodiments are described in detail with reference to drawings.

First Exemplary Embodiment

Figure 1:
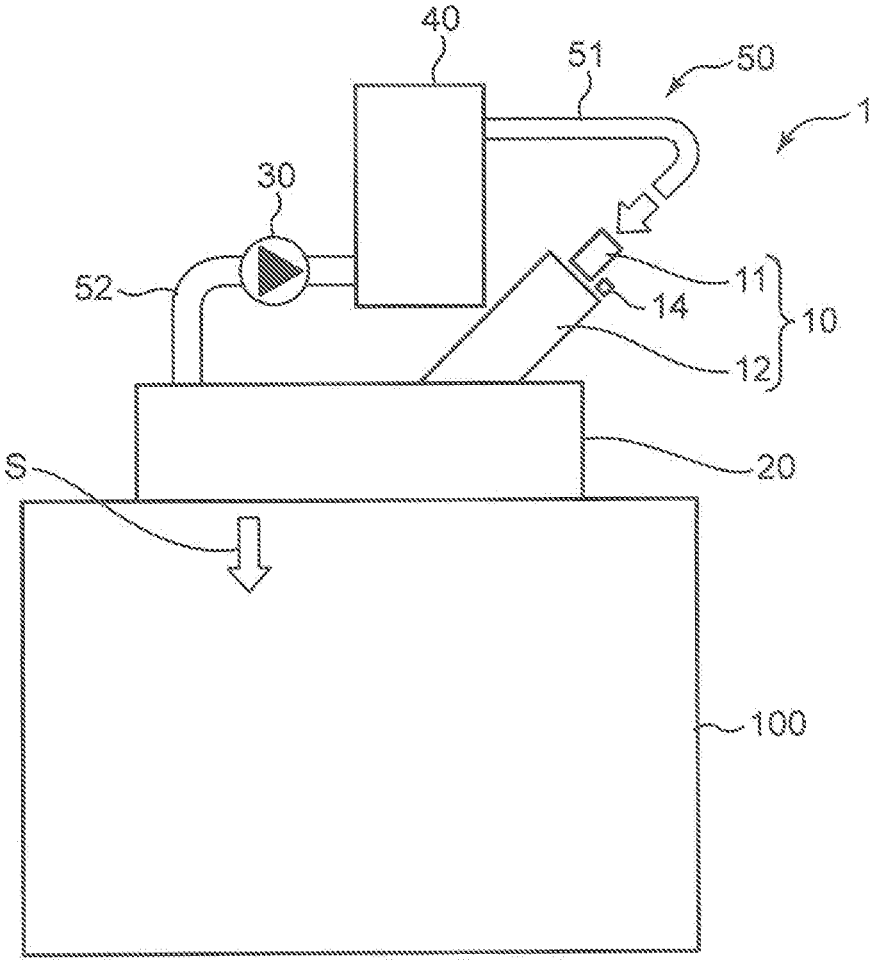
FIG. 1 is a view schematically illustrating a configuration of a snow making apparatus according to a first exemplary embodiment.

First, a configuration of a snow making apparatus 1 according to a first exemplary embodiment will be described with reference to FIG. 1 and FIG. 2. The snow making apparatus 1 is applied to a snowfall test apparatus having a test chamber 100. The snow making apparatus 1 is mounted on a ceiling portion of the test chamber 100, and makes artificial snow S that falls in the test chamber 100. The artificial snow S includes agglomerated-snowflakes (large snowflakes) formed by bonding of fine snowflakes to each other. The artificial snow S has a size (width) of about 5 to 10 mm, for example. As illustrated in FIG. 1, the snow making apparatus 1 includes: a supply unit 10; a drum 20 which is a snow making container having an inner space; a blower 30; and air conditioner 40. Further, the snow making apparatus 1 includes a circulation circuit 50 that circulates low-temperature air. In the circulation circuit 50, the supply unit 10, the drum 20, the blower 30 and the air conditioner 40 are arranged in this order. The circulation circuit 50 includes: a feed path 51 for feeding low-temperature air from the air conditioner 40 to the supply unit 10 and the drum 20; and a return path 52 for returning air from the drum 20 to the air conditioner 40. To thermally isolate the circulation circuit 50 from the test chamber 100, heat insulation is provided to the circulation circuit 50.

The supply unit 10 supplies fine snowflakes to the inner space of the drum 20. The supply unit 10 in the present exemplary embodiment includes: a snow making nozzle 11 for jetting fine water droplets; and a snow making duct 12 for guiding fine snowflakes formed from the water droplets jetted from the snow making nozzle 11 to the inner space of the drum 20.

The snow making nozzle 11 is disposed outside the snow making duct 12, and jets atomized water droplets from an inlet of the snow making duct 12 toward the inside of the snow making duct 12. As the snow making nozzle 11, a one-fluid nozzle may be used, or a two-fluid nozzle may be used.

The snow making duct 12 is disposed downstream of the snow making nozzle 11 in a circulating direction of low-temperature air. The low-temperature air whose temperature is adjusted to a temperature below a freezing point by the air conditioner 40 is introduced into the snow making duct 12. With such a configuration, the water droplets jetted from the snow making nozzle 11 become fine snowflakes in the snow making duct 12, and are guided into the drum 20. In the present exemplified embodiment, as shown in FIG. 1, an open space exists between an outlet of the feed path 51 and the inlet of the snow making duct 12, and the snow making nozzle 11 is disposed in the open space.

The snow making apparatus 1 further includes a snow adhesion preventing unit for preventing fine snowflakes from adhering to the inner surface of the snow making duct 12. The snow adhesion preventing unit includes a blower or a nozzle 14 that feeds air along the inner surface of the snow making duct 12. The air flows along the inner surface of the snow making duct 12 and hence, it is possible to prevent snow from adhering to the inner surface of the snow making duct 12. The snow adhesion preventing unit is not an indispensable in the snow making apparatus according to the present invention, and may be omitted.

The inner space of the drum 20 functions as a space for snow making. The drum 20 is disposed downstream of the supply unit 10 (snow making duct 12) in the circulating direction of the low-temperature air. In the inner space of the drum 20, agglomerated-snowflakes is made from fine snowflakes supplied from the snow making duct 12. The detailed configuration of the inside of the drum 20 will be described later.

An air blower 30 is disposed in the return path 52. The blower 30 is used for circulating low-temperature air between the air conditioner 40, the snow making duct 12, and the drum 20. The air conditioner 40 cools the air returned from the drum 20 through the return path 52, and blows out the cooled low-temperature air to the feed path 51. The low-temperature air is fed into the snow making duct 12 and the drum 20 through the feed path 51.

Next, the configuration of the inside of the drum 20 will be described in detail with reference to FIG. 2. FIG. 2 illustrates a state where the drum 20 is in a disassembled state.

Figure 2:
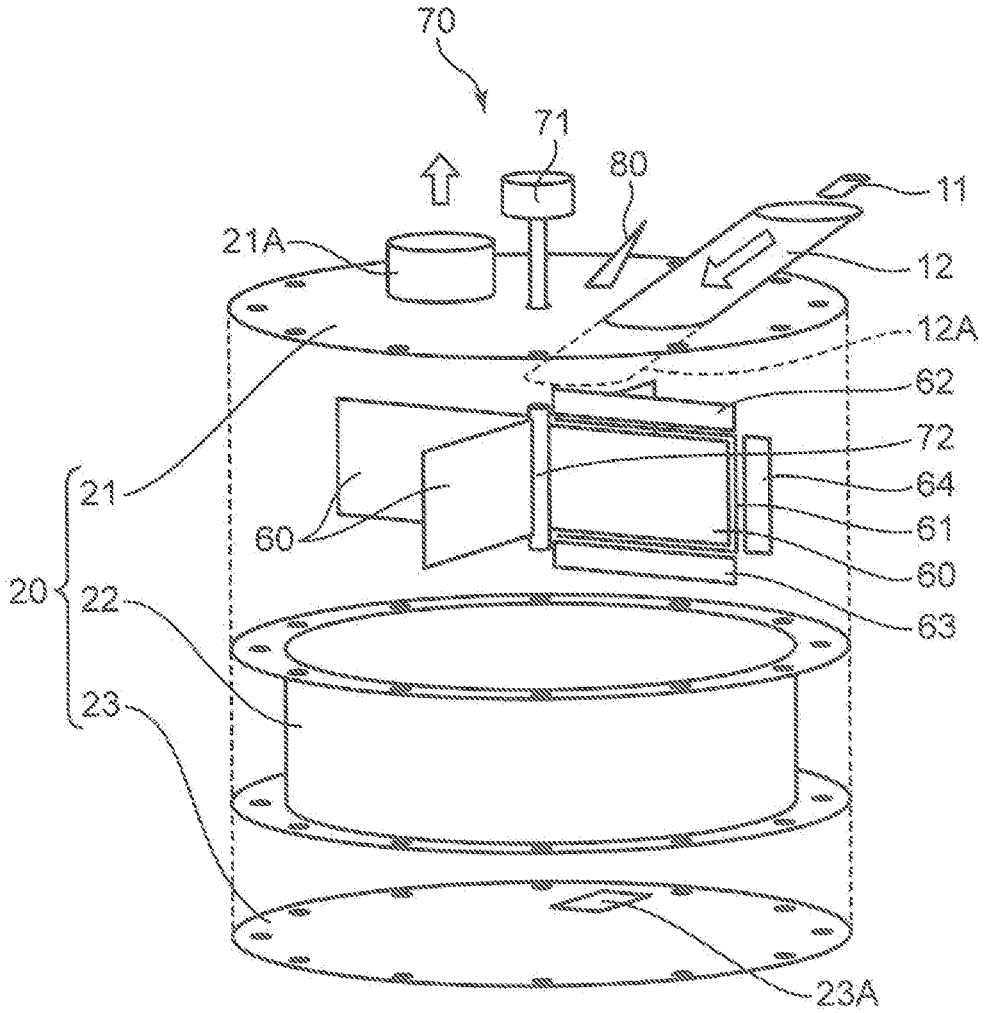
FIG. 2 is an exploded view schematically illustrating a configuration of the inside of a drum of the snow making apparatus.

As illustrated in FIG. 2, the drum 20 includes: a body portion 22 having a hollow cylindrical shape and opening at both ends; a top plate 21 having a disk shape that closes an upper-side opening of the body portion 22; and a bottom plate 23 having a disk shape that closes a lower-side opening of the body portion 22. A snow outlet 23A is formed in the bottom plate 23. The snow outlet 23A is provided for making agglomerated-snowflakes made in the drum 20 fall toward in the test chamber 100 (FIG. 1). The top plate 21 and the bottom plate 23 are mounted on both end portions of the body portion 22 respectively by fixing jigs such as screws, for example. In FIG. 2, for the sake of convenience, the drum 20 is illustrated in a state where the body portion 22 is separated from the top plate 21 and the bottom plate 23.

In the snow making duct 12, an outflow port 12A through which the fine snow made in the snow making duct 12 is allowed to flow out is formed. The outflow port 12A is formed on a side opposite to an inlet side where the snow making nozzle 11 is disposed. As illustrated in FIG. 2, a portion of the snow making duct 12 on an outflow port 12A side penetrates the top plate 21, and is inserted into an inner space of the drum 20. With such a configuration, the fine snow and the low-temperature air are supplied to the inner space of the drum 20 from the top plate 21 side. In place of the configuration where the snow making duct 12 penetrates the top plate 21, the snow making duct 12 may be configured such that an end portion of the snow making duct 12 on an outflow port 12A side is joined to the top plate 21.

An outlet 21A for air is formed in the top plate 21. Air in the drum 20 flows out from the outlet 21A to the outside of the drum 20 and, thereafter, the air returns to the air conditioner 40 through the return path 52 (FIG. 1). The outlet 21A may be omitted. In this case, low-temperature air may not be circulated between the air conditioner 40 and the drum 20.

The snow making apparatus 1 further includes: a catching unit 60 for catching fine snow supplied to the inner space of the drum 20 from the snow making duct 12; and a drive unit 70 for moving the catching unit 60 toward areas in the inner space where fine snow is flying.

In the present exemplary embodiment, the catching unit 60 is formed of a flexible sheet-like member having a quadrangular shape and made of Teflon (registered trademark). In the present exemplary embodiment, a plurality of (four in FIG. 2) catching units 60 are provided.

The drive unit 70 includes: a motor 71 mounted on the top plate 21; and a rotary shaft 72 connected to the motor 71 and penetrating the center of the top plate 21. By driving the motor 71, the rotary shaft 72 rotates about an axis of the rotary shaft 72 at constant speed. A rotational speed of the rotary shaft 72 may be variable.

The rotary shaft 72 is disposed in the drum 20 at the center in the radial direction, and supports the plurality of catching unit 60. Specifically, as illustrated in FIG. 2, the plurality of catching units 60 are arranged at an equal interval about the rotary shaft 72. Each catching unit 60 is mounted on an outer peripheral portion of the rotary shaft 72 in a posture where the catching unit 60 extends radially outwardly from the rotary shaft 72. In other words, the plurality of catching units 60 are disposed radially about the rotary shaft 72 and are fixed to the rotary shaft 72. The plurality of catching units 60 rotate about the rotary shaft 72 by driving the motor 71. With such an operation, the respective catching units 60 move in one direction in the circumferential direction.

The snow making duct 12 supplies fine snow toward a region where the rotating catching units 60 pass in the inner space of the drum 20, that is, a region disposed around the rotary shaft 72. That is, the outflow port 12A of the snow making duct 12 opens toward the region where the catching units 60 pass in the inner space of the drum 20. Accordingly, when the plurality of catching units 60 are driven, the fine snow blown out from the snow making duct 12 is caught by the main surfaces (surfaces facing the rotational direction) of the plurality of catching units 60.

The snow making apparatus 1 further includes: frames 61 (support members) that support the catching units 60; and spatula-shaped snow scraping portions attached to the frames 61. That is, the frame 61 and the snow scraping portion are mounted on each of the plurality of catching units 60. Each frame 61 is a frame member having an upper side portion, a lower side portion, and outer side portions that connect outer ends of the upper side portions and outer ends of the lower side portion. Each frame 61 surrounds an outer periphery of the catching unit 60. In the present exemplary embodiment, the catching unit 60 is mounted on the frame 61 at two points, that is at upper and lower points. However, the present invention is not limited to such a configuration.

The snow scraping portion is a portion for scraping off snow adhering to the inner surface of the drum 20. The snow scraping portion includes an upper snow scraping portion 62, a lower snow scraping portion 63, and an outer snow scraping portion 64. When the motor 71 is operated, the upper snow scraping portion 62, the lower snow scraping portion 63, and the outer snow scraping portion 64 move around the rotary shaft 72 while being in contact with the inner surface of the drum 20. These snow scraping portions may be formed of, for example, a sheet made of Teflon (registered trademark), a broom-shaped metal body, or a broom-shaped resin body. The snow scraping portion may be disposed on only one catching unit 60.

The upper snow scraping portion 62 is a portion for scraping off snow adhering to the inner surface of the top plate 21. The upper snow scraping portion 62 is mounted on an upper side portion of the frame 61 in an extending manner in the radial direction of the drum 20. The lower snow scraping portion 63 is a portion for scraping off snow adhering to the inner surface of the bottom plate 23. The lower snow scraping portion 63 is mounted on a lower side portion of the frame 61 in an extending manner in the radial direction of the drum 20. Further, the lower snow scraping portion 63 conveys the snow fallen on the bottom plate 23 to a snow outlet 23A. The outer snow scraping portion 64 is a portion for scraping off snow adhering to the inner peripheral surface of the body portion 22. The outer snow scraping portion 64 is mounted on an outer side portion of the frame 61 in an extending manner in the axial direction of the rotary shaft 72.

Figure 3:
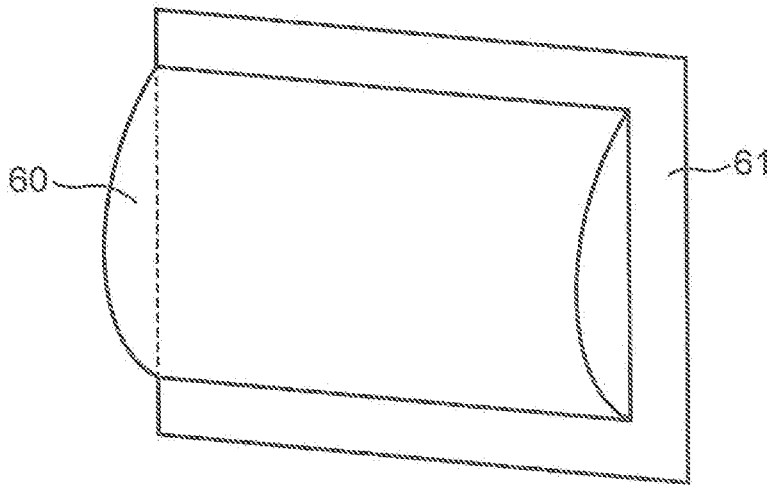
FIG. 3 is a schematic view for describing a mounting state of a catching unit.

In the present exemplary embodiment, each catching unit 60 is formed in a sheet shape and is mounted on the frame 61 in a slackened state. FIG. 3 schematically illustrates a mounting state of the catching unit 60. The size of the catching unit 60 in the vertical direction is larger than the size of the frame 61 in the vertical direction, and an upper end portion and a lower end portion of the catching unit 60 are attached to the upper side portion and the lower side portion of the frame 61 respectively. An outer side portion of the catching unit 60 is not attached to the outer side portion of the frame 61. With such a configuration, the catching unit 60 is in a state where the catching unit 60 expands in a curved shape toward a center portion in the vertical direction from an upper end portion and a lower end portion. The catching unit 60 is shaken when compressed air is blown to the catching unit 60, for example.

The catching unit 60 may have the same size as the frame 61. Also in this case, for example, at an upper end portion of the catching unit 60, only a portion of the catching unit 60 on a rotary shaft 72 side is mounted on the frame 61, and at a lower end portion of the catching unit 60, only a portion of the catching unit 60 on a side opposite to the rotary shaft 72 is mounted on the frame 61. With such a configuration, the catching unit 60 can be slackened.

In the snow making apparatus 1 according to the present exemplary embodiment, the snow caught by the catching units 60 falls off from the catching units 60 due to shaking of the catching units 60. Specifically, the snow making apparatus 1 further includes a compressed air supply unit 80 mounted on the top plate 21. Compressed air is blown from the compressed air supply unit 80 toward the catching unit 60. With such an operation, the catching units 60 are shaken, and snow falls off from the main surfaces of the catching units 60. That is, the compressed air supply unit 80 functions as a fall-off unit that causes the snow caught by the catching units 60 to fall off from the catching units 60. A blow-out port of the compressed air supply unit 80 is positioned above the snow outlet 23A.

Next, the manner of operation of the snow making apparatus 1 will be described.

First, a temperature in the inner space of the snow making duct 12 and the temperature in the inner space of the drum 20 are controlled to temperatures below a freezing point by the air conditioner 40. That is, low-temperature air whose temperature is controlled to a temperature below the freezing point by the air conditioner 40 is supplied to the inner space of the snow making duct 12 and the inner space of the drum 20 through the feed path 51 (FIG. 1). Then, the air that flows out from the outlet 21A (FIG. 2) of the drum 20 returns to the air conditioner 40 through the return path 52 (FIG. 1).

On the other hand, when atomized water droplets are jetted into the snow making duct 12 from the snow making nozzle 11, the water droplets turned into the fine snow in the low-temperature air. Then, the fine snow is introduced into the inner space of the drum 20 through the snow making duct 12.

In the inner space of the drum 20, a state is brought about where the fine snow is flying in the entire inner space. When the rotary shaft 72 is rotated about the axis of the rotary shaft 72 by driving the motor 71 in such a state, the catching units 60 move around the rotary shaft 72. That is, the catching units 60 move toward places where the fine snow is flying. With such an operation, the fine snow flying in the inner space of the drum 20 is efficiently caught by the catching unit 60, and hence, the fine snow adheres to the main surfaces of the catching units 60. A part of the fine snow supplied from the snow making duct 12 is directly blown off to the catching units 60.

Then, the fine snow is stacked on the main surface of the catching unit 60 and hence, agglomerated-snowflakes formed of snowflakes having a large size is made. The agglomerated-snowflakes falls off from the catching unit 60 by blowing compressed air to the catching units 60 from the compressed air supply unit 80. The fallen agglomerated-snowflakes is accumulated on the bottom plate 23 of the drum 20, and the agglomerated-snowflakes is moved on the bottom plate 23 and is made to fall off through a snow outlet 23A by the lower snow scraping portion 63. As descried above, in the test chamber 100 (FIG. 1), it is possible to reproduce a snowfall environment of agglomerated-snowflakes.

Second Exemplary Embodiment

Next, a snow making apparatus according to a second exemplary embodiment will be described. The second exemplary embodiment basically has substantially the same configuration as the first exemplary embodiment. However, the second exemplary embodiment differs from the first exemplary embodiment with respect to the configuration for shaking catching units 60. Hereinafter, only points which make the second exemplary embodiment differ from the first exemplary embodiment are described.

Figure 4:
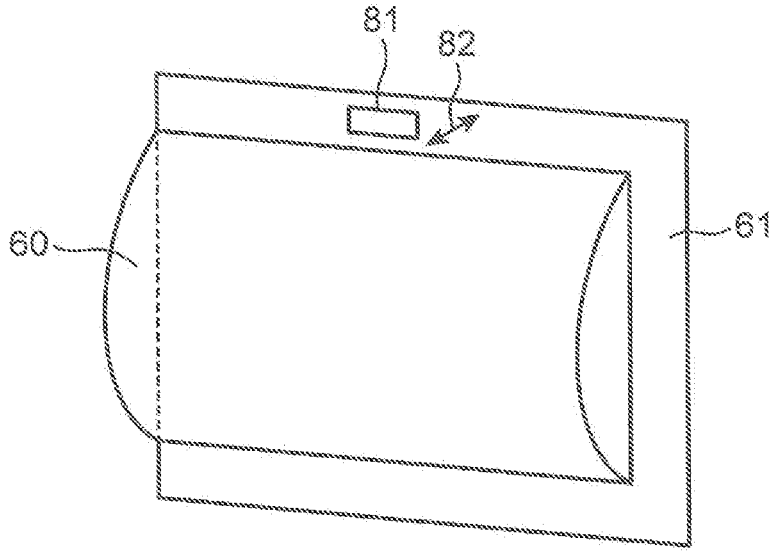
FIG. 4 is a schematic view for describing a striking body and a moving mechanism in a snow making apparatus according to a second exemplary embodiment.

As illustrated in FIG. 4, the snow making apparatus according to the second exemplary embodiment includes a striking body 81 that strikes and shakes the catching unit 60 in place of the compressed air supply unit 80 (FIG. 2). The snow making apparatus further includes a moving mechanism 82 for moving the striking body 81 between a striking position where the striking body 81 strikes the catching unit 60 and a retracted position located away from the catching unit 60. The striking body 81 and the moving mechanism 82 function as a fall-off unit for making the snow caught by the catching unit 60 fall off from the catching unit 60.

When a certain amount of snow is stacked on the catching unit 60 and agglomerated-snowflakes are made on the catching unit 60, the striking body 81 moves from the retracted position to the striking position, and impinges on the frame 61. With such an operation, the catching unit 60 is shaken so that it is possible to make the agglomerated-snowflakes fall off from the catching unit 60.

A vibrating body (not illustrated) that vibrates the catching unit 60 may be used in place of the striking body 81 and the moving mechanism 82. The vibrating body may be configured to vibrate in a state where the vibrating body is brought into contact with the frame 61, or the vibrating body may directly vibrate the catching unit 60 in a state where the vibrating body is brought into contact with the catching unit 60. These components may also be used together with the compressed air supply unit 80.

Third Exemplary Embodiment

Next, a snow making apparatus according to a third exemplary embodiment will be described. The third exemplary embodiment is basically substantially equal to the first and second exemplary embodiments. However, the third exemplary embodiment differs from the first and second exemplary embodiments in the manner of shaking the catching unit 60. Hereinafter, only the points which make the third exemplary embodiment different from the first and second exemplary embodiments are described.

In the third exemplary embodiment, agglomerated-snowflakes fall off from the catching unit 60 due to shaking of the catching unit 60 generated by a wind pressure from the snow making duct 12. Specifically, air supplied from the snow making duct 12 flows in the drum 20 while changing a flow direction into a circumferential direction so that the catching unit 60 is shaken and the agglomerated-snowflakes fall off from the catching unit 60. That is, the snow making duct 12 blows out an air flow for shaking the catching unit 60 so that the agglomerated-snowflakes fall off.

With such an operation, in the same manner as the first and second exemplary embodiments, it is possible to reproduce a snowfall environment where agglomerated-snowflake are made to fall off from the catching unit 60. In the third exemplary embodiment, the catching unit 60 is shaken using the flow of a circulating air. Accordingly, it is not necessary to provide the compressed air supply unit 80 (FIG. 2) and the striking body 81 and hence, the configuration of the snow making apparatus can be further simplified.

Fourth Exemplary Embodiment

Next, a snow making apparatus according to a fourth exemplary embodiment will be described. The fourth exemplary embodiment is basically substantially equal to the first exemplary embodiment. However, the forth exemplary embodiment differs from the first exemplary embodiment with respect to a point that snow is made to fall off from the catching unit 60 without shaking the catching unit 60. Hereinafter, only points which make the fourth exemplary embodiment differ from the first exemplary embodiment are described.

In the fourth exemplary embodiment, the catching unit 60 is formed of a member that is not shaken (minimally deformed) by blowing of the compressed air, for example, a metal wire mesh, a porous plate, or the like. The compressed air supply unit 80 functions as a fall-off unit for making snow caught by the catching unit 60 fall off from the catching unit 60. Specifically, although the catching unit 60 per se is not shaken by compressed air blown from the compressed air supply unit 80, snow stacked on the catching unit 60 falls off from the catching unit 60 by receiving a force of the compressed air.

According to the fourth exemplary embodiment, it is unnecessary to mount the catching unit 60 on the frame 61 such that the catching unit 60 is easily shaken. The forth embodiment is also not limited to a case where a member which is easily shaken, such as a flexible sheet is used as the catching unit 60. Accordingly, a degree of freedom in forming the catching unit 60 is increased.

Fifth Exemplary Embodiment

Next, a snow making apparatus according to a fifth exemplary embodiment will be described. The fifth exemplary embodiment is basically substantially equal to the first exemplary embodiment. However, the fifth exemplary embodiment differs from the first exemplary embodiment with respect to a point that the snow making nozzle 11 is disposed in the drum 20. Hereinafter, only points which make the fifth exemplary embodiment differ from the first exemplary embodiment are described.

Figure 5:
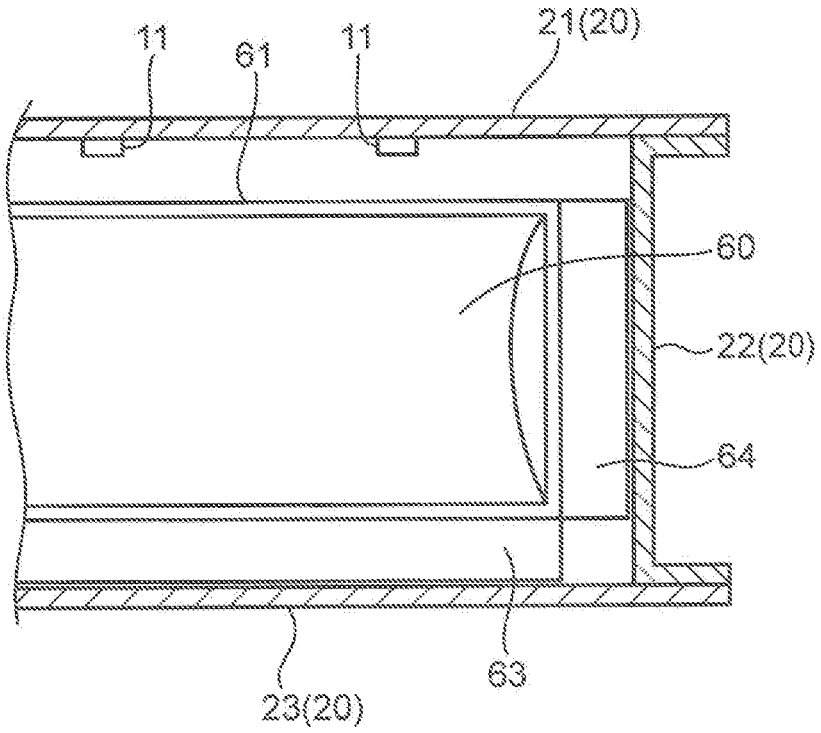
FIG. 5 is a schematic views for describing a snow making nozzle disposed in a snow making apparatus according to a fifth exemplary embodiment.

In this exemplary embodiment, the supply unit 10 includes the snow making nozzles 11 which supply fine water droplets into the inner space of the drum 20, and do not include the snow making duct 12 (FIG. 1). As illustrated in FIG. 5, the snow making nozzles 11 are disposed in a downwardly directed manner in the inner space of the drum 20 in the vicinity of the top plate 21. More specifically, the snow making nozzles 11 are disposed in the inner space of the drum 20 above the region where the catching units 60 rotate and pass, and supplies fine water droplets toward the region where the catching units 60 pass in a region around the rotary shaft 72. Only one snow making nozzle 11 may be disposed in the drum 20, or a plurality of snow making nozzles 11 may be disposed. In the configuration illustrated in FIG. 5, the upper snow scraping portion 62 is omitted.

In the present exemplary embodiment, a height of the drum 20 is set larger than the height of the drum 20 in the first exemplary embodiment. That is, the height of the drum 20 is larger than a height of the frame 61. With such a configuration, even in a case where the snow making nozzle 11 is disposed in the drum 20, a certain distance or more can be secured between the snow making nozzle 11 and the catching unit 60.

A temperature in the inner space of the drum 20 is controlled to below a freezing point by the air conditioner 40 (FIG. 1). Accordingly, in the inner space of the drum 20, fine snow is formed from water droplets jetted from the snow making nozzle 11, and the fine snow is caught by the catching units 60 moving around the rotary shaft 72. Then, in the same manner as the first exemplary embodiment, agglomerated-snowflakes are made on the main surface of the catching unit 60, and the snow falls off from the catching unit 60 by shaking the catching unit 60. According to the present exemplary embodiment, the snow making duct 12 can be omitted and hence, the configuration of the snow making apparatus can be further simplified.

OTHER EXEMPLARY EMBODIMENTS

Other exemplary embodiments of the present invention are described hereinafter.

Figure 6:
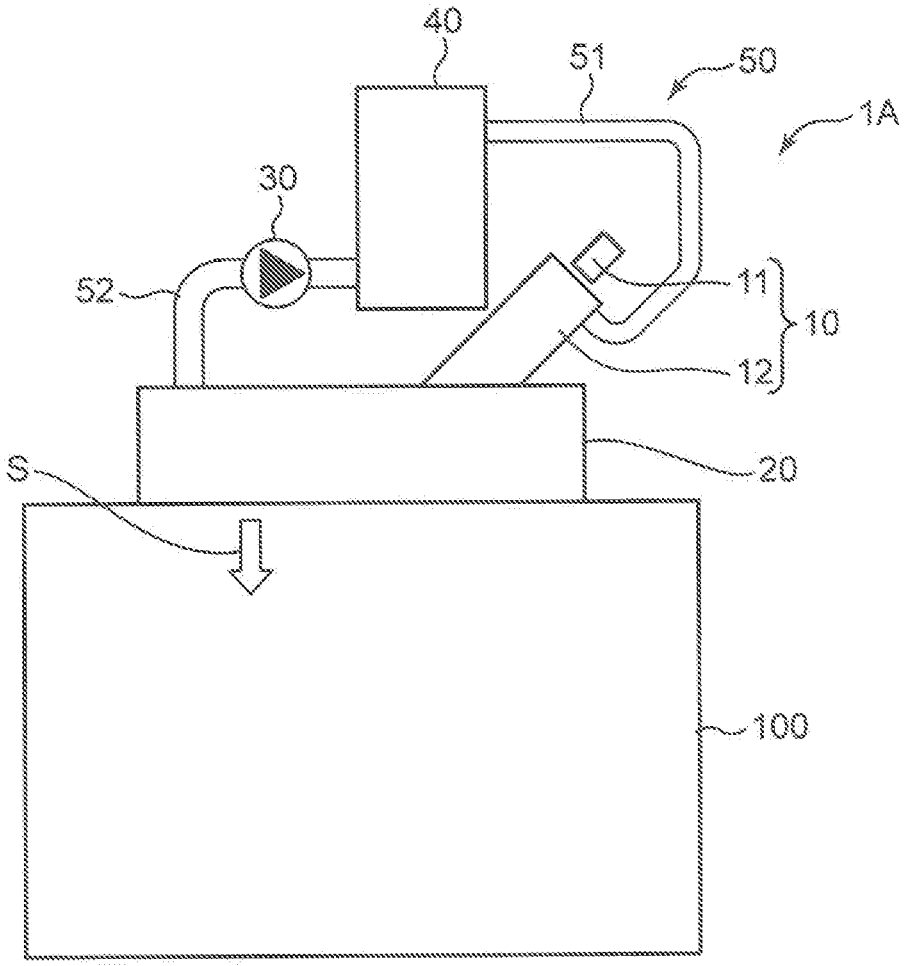
FIG. 6 is a view schematically illustrating a snow making apparatus according to another exemplary embodiment.

As illustrated in FIG. 6, a downstream end of the feed path 51 may be connected to a portion (for example, a duct side peripheral portion) of the snow making duct 12 other than the inlet. In this case, the snow making nozzle 11 may be positioned outside the snow making duct 12 or may be positioned inside the snow making duct 12. In this case, water droplets are jetted from the snow making nozzle 11 toward air-conditioned air fed from the feed path 51. A downstream end of the feed path 51 may be connected to the snow making duct 12, and the snow making nozzle 11 may be positioned in the feed path 51.

Figure 7:
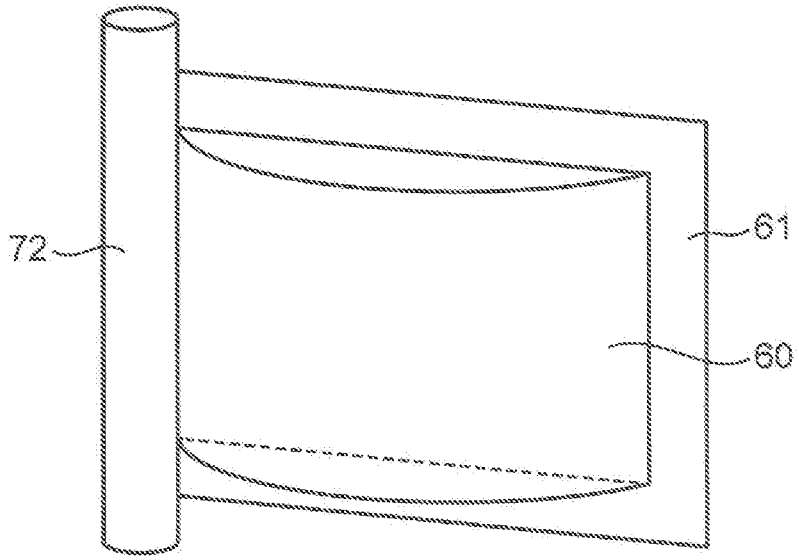
FIG. 7 is a schematic view for describing a mounting state of a catching unit according to another exemplary embodiment.

The catching unit 60 is not limited to the case where the catching unit 60 is attached to the frame 61 at two upper and lower positions. For example, as illustrated in FIG. 7, the catching unit 60 may be attached to the frame 61 at two positions on left and right sides. In this case, the catching unit 60 is fixed to an outer side portion of the frame 61 and the rotary shaft 72, but is not fixed to the upper side portion and the lower side portion of the frame 61.

A snow quality adjusting nozzle (not illustrated) may be disposed below the snow outlet 23A so as to enable falling of more wetted artificial snow S in the test chamber 100.

In the first exemplary embodiment, the configuration where the catching unit 60 is shaken by blowing compressed air to the catching unit 60 has been described as one example. The respective exemplary embodiments are not limited to such configuration. For example, it may be possible to make snow fall off from the catching unit 60 by shaking the catching unit 60 with a blower (not illustrated). As another unit for shaking the catching unit 60, it may be possible to provide a unit that suddenly stops the catching unit 60 that is rotating. In this case, the catching unit 60 is shaken due to a sudden stoppage of the catching unit 60 so that snow falls off from the catching unit 60.

In the first exemplary embodiment, the sheet-like member made of Teflon (registered trademark) is described as an example of the catching unit 60. However, the invention is not limited to such a case. For example, a sheet-like member made of high density polyethylene, a mesh-like member made of Teflon (registered trademark), a metal plate, a cloth, or the like may be used as the catching unit 60. The present invention is not limited to the case where a plurality of catching units 60 are disposed, and only one catching unit 60 may be disposed.

The drive unit 70 is not limited to the configuration where the catching units 60 are rotated about the rotary shaft 72 only in one direction. For example, the drive unit 70 may not allow the catching units 60 to rotate up to 360° about the rotary shaft 72, and may change the direction of movement of the catching units 60 in the circumferential direction every time the catching units 60 are rotated by 180° about the rotary shaft 72, for example. That is, the direction of movement of the catching units 60 may be changed by rotating the rotary shaft 72 in the forward and reverse directions.

Further, the drive unit 70 is not limited to the configuration of rotating the catching units 60, and the drive unit 70 may allow the catching units 60 to perform the translational motion. In this case, the drive unit 70 is configured to linearly move the catching units 60 using a ball screw or the like in place of rotating the rotary shaft 72 by the motor 71. In such a case, it is preferable that the drum 20 be formed of a polygonal (quadrangular) tube.

The outflow port 12A of the snow making duct 12 may open toward a region other than the region where the catching units 60 pass in the inner space of the drum 20.

The catching unit 60 is not limited to the case where the catching unit 60 is supported by the frame 61 in a slackened state, and the catching unit 60 may be supported by the frame 61 in a stretched state.

Some or all of the upper snow scraping portion 62, the lower snow scraping portion 63, and the outer snow scraping portion 64 may be omitted. When all of these are omitted, a striking body that strikes the top plate 21 and the body portion 22 of the drum 20 may be provided. A vibrating body that vibrates the top plate 21 and the body portion 22 may be provided. A nozzle that blows compressed air to an inner surface of the top plate 21 and an inner surface of the body portion 22 may be provided. Such a nozzle can make snow fall off from the top plate 21 and the body portion 22. The striking body is disposed outside or inside the drum 20 and is configured to strike the drum 20. The vibrating body is arranged to be brought into contact with the drum 20 and is configured to vibrate the drum 20. All of the snow scraping portions 62, 63 and 64, the striking body, the vibrating body, and the nozzle form snow falling accelerators for making snow adhering to the inner surface of the drum 20 (snow making container) fall off from the inner surface.

The catching unit 60 is not limited to the case where the catching unit 60 is attached to the frame 61 in an arcuately curved state as illustrated in FIG. 3. The catching unit 60 may be attached in a state where the catching unit 60 is curved in a wave shape, for example.

The bottom plate 23 may be omitted. In this case, the drum 20 takes a state where the lower surface of the drum 20 is completely opened. Also in this case, the lower snow scraping portion 63 is also omitted.

The snow making nozzle 11 may be disposed in the snow making duct 12.

The size of snow may be adjusted by adjusting a rotational speed of the rotary shaft 72 or a jetting amount of water droplets from the snow making nozzle 11.

The shape of the catching unit 60 is not limited to a rectangular shape, and other shapes may be adopted. For example, the shape of the catching unit 60 may be a shape such as a trapezoidal shape where an end portion of the drum 20 positioned on an outer side in a radial direction is longer than an end portion of the drum 20 positioned on an inner side in a radial direction. In this case, the catching unit 60 is attached to the frame 61 in a state where a radially outer portion of the catching unit 60 is slackened. Accordingly, the catching unit 60 is shaken by blowing off compressed air or the like to the catching unit 60. On the other hand, since a radially inner portion of the catching unit 60 is attached to the frame 61 in a stretched state, the catching unit 60 is less likely to be shaken. As a result, it is possible to suppress interference between catching units 60 disposed adjacently to each other around the rotary shaft 72. The shape of the catching unit 60 is not limited to a trapezoidal shape, and may be a shape including a curved portion in a profile of the shape.

In a case where the inlet of the snow making duct 12 is open, the open space may be cooled or may be at a room temperature.

It should be construed that the exemplary embodiments disclosed in this specification are illustrative in all aspects, and are not limitative. The scope of the present invention is not limited by the above-mentioned description but is limited by the claims, and it is intended that the scope of the present invention includes all modifications within the meaning and the scope equivalent to the claims.

The above-mentioned exemplary embodiments are recapitulated as follows.

(1) The snow making apparatus according to the exemplary embodiment includes: the snow making container having the inner space for snow making; the supply unit configured to supply fine snow or fine water droplets to the inner space; the catching units for catching the fine snow or fine snow formed from the water droplets; and the drive unit configured to move the catching units toward the place where the fine snow is flying in the inner space. The catching unit is configured to be shaken thereby making snow caught by the catching unit fall off from the catching unit.

According to the snow making apparatus, the drive unit moves the catching units toward the place where the fine snow is flying in the inner space of the snow making container and hence, the fine snow can be efficiently attached to the catching units. As a result, the fine snow is easily stacked in the catching units and hence, it is possible to efficiently form agglomerated-snowflakes as compared with conventional snow making apparatuses. Further, even in a state where the fine snow is flying in the snow making container, the fine snow can be efficiently caught.

In the above-mentioned exemplary embodiments, "fine snow" caught by the catching unit includes not only the fine snow itself supplied from the supply unit or the fine snow itself formed from the water droplets supplied from the supply unit, but also the fine snow grown by being bonded to each other in the inner space of the snow making container.

(2) In the above-mentioned snow making apparatus, the catching units may be configured to fall off the snow from the catching units by being shaken by wind pressure from the supply unit.

With such configuration, the supply unit has a function of shaking the catching units, it is not necessary to provide a configuration for shaking the catching units other than the supply unit. Accordingly, configuration of the snow making apparatus can be simplified.

(3) The snow making apparatus according to the above-mentioned embodiment includes: the snow making container having the inner space for snow making; the supply unit configured to supply fine snow or fine water droplets to the inner space; the catching units for catching the fine snow or fine snow formed from the water droplets; the drive unit configured to move the catching units toward a place where the fine snow is flying in the inner space; and the fall-off unit configured to make snow caught by the catching units fall off from the catching units.

With such configuration, it is possible to make the fine snow flying in the inner space of the snow making container efficiently adhere to the catching units. Accordingly, agglomerated-snowflakes can be efficiently made. Moreover, the snow caught by the catching unit can be made to fall off from the catching unit by the fall-off unit and hence, a snowfall environment of agglomerated-snowflakes can be efficiently created.

(4) In the above-mentioned snow making apparatus described above, the drive unit may be configured to rotate the rotary shaft that supports the catching units, and in this case, the catching units may be movable due to rotation of the rotary shaft by the drive unit.

With such configuration, the snow making apparatus can efficiently catch the fine snow flying in the inner space of the snow making container with the simple device configuration.

(5) In the above-mentioned snow making apparatus, the supply unit is configured to supply the fine snow or the water droplets toward the region where the catching units rotate and pass in the inner space.

With such configuration, the fine snow supplied from the supply unit or the fine snow formed from the water droplets supplied from the supply unit is easily directly caught by the catching unit. Accordingly, it is possible to efficiently make agglomerated-snowflakes in the catching units.

(6) In the above-mentioned snow making apparatus, the plurality of catching units including the catching unit may be disposed around the rotary shaft.

With such configuration, the plurality of catching units are provided and hence, a catching area can be increased whereby the fine snow flying in the inner space of the snow making container can be efficiently caught.

(7) The snow making apparatus may further include the support members that support each catching unit. The catching unit may be supported by the support member in a slackened state.

With such configuration, the catching unit can be easily shaken and hence, it is possible to easily fall off agglomerated-snowflakes from the catching unit.

(8) In the snow making apparatus described above, the supply unit may include the snow making nozzle configured to jet the water droplets, and the snow making duct that guides the fine snow formed from the water droplets jetted from the snow making nozzle to the inner space.

With such configuration, it is possible to secure a long distance between the snow making nozzle and the catching units as compared with a case where the snow making nozzle is disposed in the snow making container. Accordingly, it is possible to suppress snow made of coarse ice particles from being caught by the catching units.

(9) The above-mentioned snow making apparatus may further include the snow adhesion preventing unit that prevents the fine snow from adhering to the inner surface of the snow making duct.

With such configuration, it is possible to suppress clogging of the snow making duct by the snow.

(10) In the above-mentioned snow making apparatus, the snow making duct may include the outflow port through which the fine snow is made to flow out, and the outflow port may open toward the region where the catching units passes.

With such configuration, the fine snow flowing out from the snow making duct is caught by the moving catching units and hence, the snow is more easily stacked on the catching units.

(11) The above-mentioned embodiment discloses the snowfall test apparatus that includes the test chamber and the snow making apparatus for making snow to be supplied to the test chamber.

As is apparent from the description made heretofore, the present invention can provide a snow making apparatus capable of efficiently making agglomerated-snowflakes.

This application is based on Japanese Patent Application No. 2021-4842 filed on Jan. 15, 2021, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

The invention claimed is:

1. A snow making apparatus comprising:

a snow making container having an inner space for snow making;

a supply unit configured to supply fine snow or fine water droplets to the inner space;

a catching unit for catching the fine snow or fine snow formed from the water droplets; and a drive unit configured to move the catching unit toward a place where the fine snow is flying in the inner space, wherein the catching unit is configured to be shaken thereby making snow caught by the catching unit fall off from the catching unit, wherein the supply unit includes:

a snow making nozzle configured to jet the water droplets; and a snow making duct configured to guide the fine snow formed from the water droplets jetted from the snow making nozzle to the inner space, wherein the snow making duct includes an outflow port through which the fine snow is made to flow out, and the outflow port opens toward the region where the catching unit passes.

2. The snow making apparatus according to claim 1, wherein the drive unit is configured to rotate a rotary shaft that supports the catching unit, and the catching unit is movable due to rotation of the rotary shaft by the drive unit.

3. The snow making apparatus according to claim 2, wherein the supply unit is configured to supply the fine snow or the water droplets toward a region where the catching unit rotates and passes in the inner space.

4. The snow making apparatus according to claim 2, wherein a plurality of catching units including the catching unit are disposed around the rotary shaft.

5. The snow making apparatus according to claim 1, further comprising a snow adhesion preventing unit configured to prevent the fine snow from adhering to an inner surface of the snow making duct.

6. A snowfall test apparatus comprising:

a test chamber; and the snow making apparatus according to claim 1 for making snow to be supplied to the test chamber.

7. A snow making apparatus, comprising:

a snow making container having an inner space for snow making;

a supply unit configured to supply fine snow or fine water droplets to the inner space;

a catching unit for catching the fine snow or fine snow formed from the water droplets; and a drive unit configured to move the catching unit toward a place where the fine snow is flying in the inner space, wherein the catching unit is configured to fall off the snow from the catching unit by being shaken by wind pressure from the supply unit.

8. A snowfall test apparatus comprising:

a test chamber; and the snow making apparatus according to claim 7 for making snow to be supplied to the test chamber.

9. A snow making apparatus, comprising:

a snow making container having an inner space for snow making;

a supply unit configured to supply fine snow or fine water droplets to the inner space;

a catching unit for catching the fine snow or fine snow formed from the water droplets;

a drive unit configured to move the catching unit toward a place where the fine snow is flying in the inner space; and a support member configured to support the catching unit, wherein the catching unit is supported by the support member in a slackened state, and the catching unit is configured to be shaken thereby making snow caught by the catching unit fall off from the catching unit.

10. A snowfall test apparatus comprising:

a test chamber; and the snow making apparatus according to claim 9 for making snow to be supplied to the test chamber.

11. A snow making apparatus comprising:

a snow making container having an inner space for snow making;

a supply unit configured to supply fine snow or fine water droplets to the inner space;

a catching unit for catching the fine snow or fine snow formed from the water droplets;

a drive unit configured to move the catching unit toward a place where the fine snow is flying in the inner space;

a fall-off unit configured to make snow caught by the catching unit fall off from the catching unit; and a support member configured to support the catching unit, wherein the catching unit is supported by the support member in a slackened states.

12. The snow making apparatus according to claim 11, wherein the drive unit is configured to rotate a rotary shaft that supports the catching unit, and the catching unit is movable due to rotation of the rotary shaft by the drive unit.

13. The snow making apparatus according to claim 12, wherein the supply unit is configured to supply the fine snow or the water droplets toward a region where the catching unit rotates and passes in the inner space.

14. The snow making apparatus according to claim 12, wherein a plurality of catching units including the catching unit are disposed around the rotary shaft.

15. A snowfall test apparatus comprising:

a test chamber; and the snow making apparatus according to claim 11 for making snow to be supplied to the test chamber.

16. A snow making apparatus, comprising:

a snow making container having an inner space for snow making;

a supply unit configured to supply fine snow or fine water droplets to the inner space;

a catching unit for catching the fine snow or fine snow formed from the water droplets;

a drive unit configured to move the catching unit toward a place where the fine snow is flying in the inner space; and a fall-off unit configured to make snow caught by the catching unit fall off from the catching unit, wherein the supply unit includes:

a snow making nozzle configured to jet the water droplets; and a snow making duct configured to guide the fine snow formed from the water droplets jetted from the snow making nozzle to the inner space, wherein the snow making duct includes an outflow port through which the fine snow is made to flow out, and the outflow port opens toward the region where the catching unit passes.

17. The snow making apparatus according to claim 16, further comprising a snow adhesion preventing unit configured to prevent the fine snow from adhering to an inner surface of the snow making duct.

18. A snowfall test apparatus comprising:

a test chamber; and the snow making apparatus according to claim 16 for making snow to be supplied to the test chamber.

* * * * *